US007264116B2

(12) United States Patent
Prentza

(10) Patent No.: US 7,264,116 B2
(45) Date of Patent: Sep. 4, 2007

(54) PROTECTIVE LAPTOP-BRIEFCASE WITH SPRINGS

(76) Inventor: Evaggelia Prentza, 14 Kedron Street, Ekali Attikis (GR) GR-14578

( * ) Notice: Subject to any disclaimer, the term of this patent is extended or adjusted under 35 U.S.C. 154(b) by 61 days.

(21) Appl. No.: 10/537,191

(22) PCT Filed: Nov. 13, 2003

(86) PCT No.: PCT/GR03/00054

§ 371 (c)(1),
(2), (4) Date: Jun. 2, 2005

(87) PCT Pub. No.: WO2004/052139

PCT Pub. Date: Jun. 24, 2004

(65) Prior Publication Data

US 2006/0124499 A1 Jun. 15, 2006

(30) Foreign Application Priority Data

Dec. 9, 2002 (GR) ..... 020100528

(51) Int. Cl.
*B65D 85/30* (2006.01)

(52) U.S. Cl. ..... 206/320; 206/521; 206/594

(58) Field of Classification Search ..... 206/320, 206/576, 583, 591, 592, 594, 521
See application file for complete search history.

(56) References Cited

U.S. PATENT DOCUMENTS 4,981,215 A * 1/1991 Ilic ..... 206/320
5,226,557 A 7/1993 Nelson
5,622,262 A 4/1997 Sadow
5,676,509 A * 10/1997 Enzu ..... 206/522
5,810,171 A 9/1998 Lee
5,887,777 A * 3/1999 Myles et al. ..... 206/320
5,909,806 A * 6/1999 Fischel et al. ..... 206/320
6,042,416 A * 3/2000 Lopes ..... 206/320
6,131,734 A * 10/2000 Hollingsworth et al. .... 206/320
6,229,698 B1 * 5/2001 Harvey ..... 206/320

FOREIGN PATENT DOCUMENTS

SU 1638073 3/1991
WO WO-0226074 4/2002

* cited by examiner

*Primary Examiner*—Luan K Bui
(74) *Attorney, Agent, or Firm*—David A. Guerra

(57) ABSTRACT

A protective portable computer briefcase for protecting and securely transporting a portable computer. The briefcase has a bottom part, a top cover part pivotally attached to the bottom part, and an interior flexible case located in the bottom part and which can receive the portable computer therein. The top part has a plurality of springs, a plurality of plates, and an interior lining. The plates extend between opposing sides of the top part to create a mesh with the springs extending from the top part to the mesh. The interior flexible case defines a recess adapted to receive the portable computer. The interior flexible case has a plurality of springs, a plurality of plates, and an interior lining. The plates extend between opposing sides and are parallel to the base to create a mesh. The interior lining covers the mesh and springs, thereby absorbing vibration.

19 Claims, 4 Drawing Sheets

PROTECTIVE LAPTOP-BRIEFCASE WITH SPRINGS

CROSS-REFERENCE TO RELATED APPLICATIONS

This application is an U.S. national phase application under 35 U.S.C. §371 based upon co-pending International Application No. PCT/GR2003/000054 filed Nov. 13, 2003. Additionally, this U.S. national phase application claims the benefit of priority of co-pending International Application No. PCT/GR2003/000054 filed Nov. 13, 2003 and Greece Application No. GR 020100528 filed Dec. 9, 2002. The entire disclosures of the prior applications are incorporated herein by reference. The international application was published Jun. 24, 2004 under Publication No. WO 2004/052139 A1.

BACKGROUND OF THE INVENTION

1. Field of the Invention

The invention refers to a laptop-briefcase, containing plates, springs and flexible case in the interior so that the laptop is fitted correctly and remains safely in place.

2. Description of Related Art

Other bags used to transport laptops have a lining made of foamed material and other stuff. In case the bag is strongly hit, there is danger regarding the safety of the laptop.

BRIEF SUMMARY OF THE INVENTION

In view of the foregoing disadvantages inherent in the known types of bags now present in the prior art, the present invention provides an improved protective laptop-briefcase with springs, and overcomes the above-mentioned disadvantages and drawbacks of the prior art. As such, the general purpose of the present invention, which will be described subsequently in greater detail, is to provide a new and improved protective laptop-briefcase with springs and method which has all the advantages of the prior art mentioned heretofore and many novel features that result in a protective laptop-briefcase with springs which is not anticipated, rendered obvious, suggested, or even implied by the prior art, either alone or in any combination thereof.

The advantage of this invention are the plates and springs inside a flexible case, which absorb the energy and vibration generated by a strong hit, reducing the risk of the laptop being damaged.

In order to achieve better safety, it is advisable to use different sizes of plates, springs and material, in order to create a first and second stage of energy absorption.

In the interior case, the vertical and horizontal sides are jointed with pliable texture, so that the size of the case can be reduced and increased depending on the size of the laptop and the portable remains in place.

BRIEF DESCRIPTION OF THE SEVERAL VIEW OF THE DRAWING(S)

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
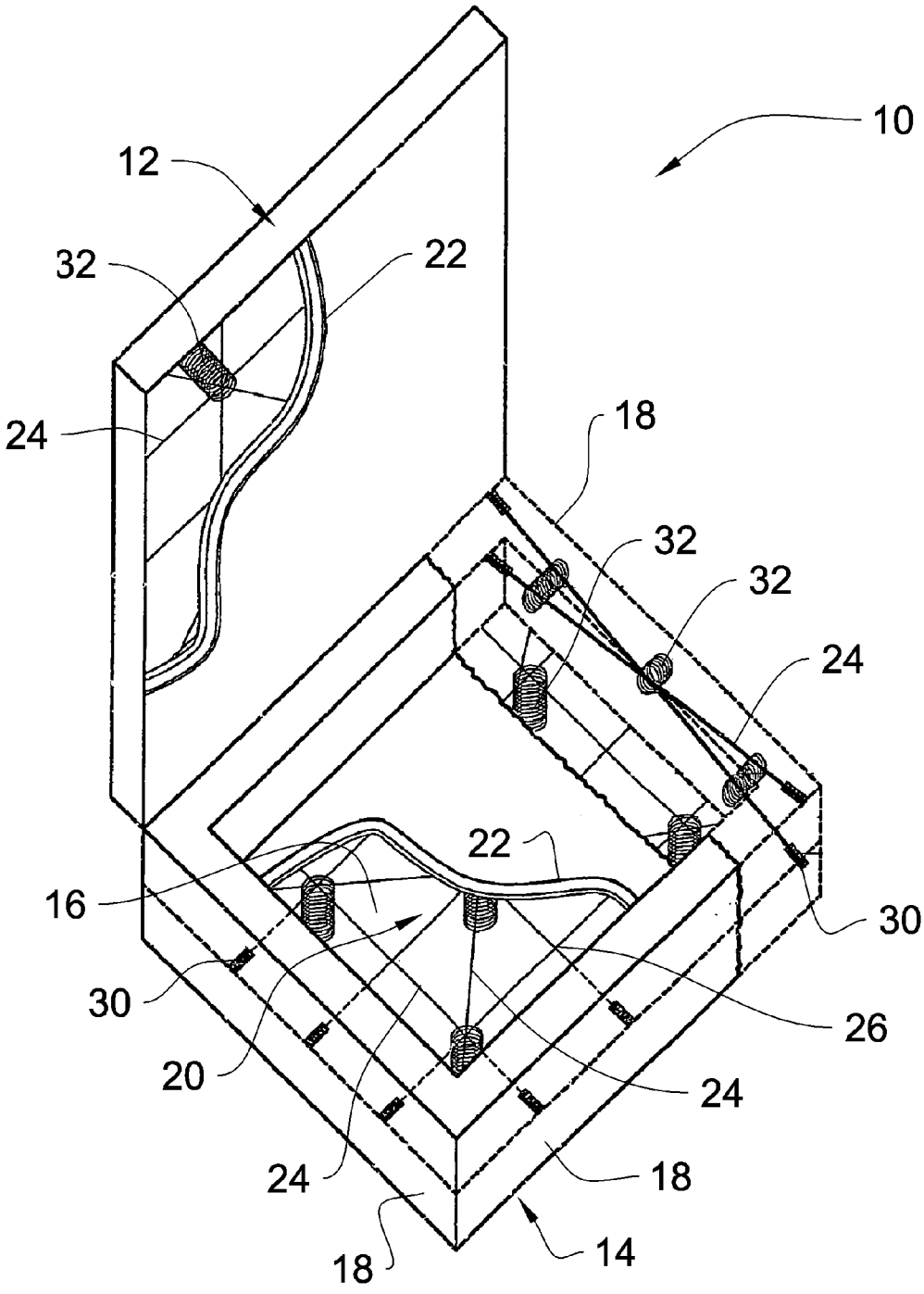
FIG. 1 is a perspective view of the preferred embodiment of the protective laptop-briefcase with springs constructed in accordance with the principles of the present invention.

Referring now to the drawings, and particularly to FIGS. 1-4, a preferred embodiment of the protective laptop-briefcase of the present invention is shown and generally designated by the reference numeral 10.

In FIG. 1, a new and improved protective laptop-briefcase 10 of the present invention for securely transporting a portable computer is illustrated and will be described. More particularly, the improved protective laptop-briefcase 10 has a top cover part 12 pivotally attached to a bottom part 14 defining a recess adapted to receive a portable computer therein. The bottom part 14 includes a base 16, sides 18, and an interior flexible case 20. The interior flexible case 20 consists of an interior lining 22, a plurality of plates 24, and a plurality of springs 28, 30, 32.

The plates 24 are arranged in the base 16 to create a mesh 26, with each edge of plates 24 incorporating the springs 30 which is adjacent to the sides 16 of the bottom part 14 of the briefcase 10. The springs 30 are helpful, since they provide the mesh 26 with full elasticity, which can absorb the energy generated by vibration. The interior lining 22 is used to cover the mesh 26, plates 24, and springs 28, 30, 32.

Figure 2:
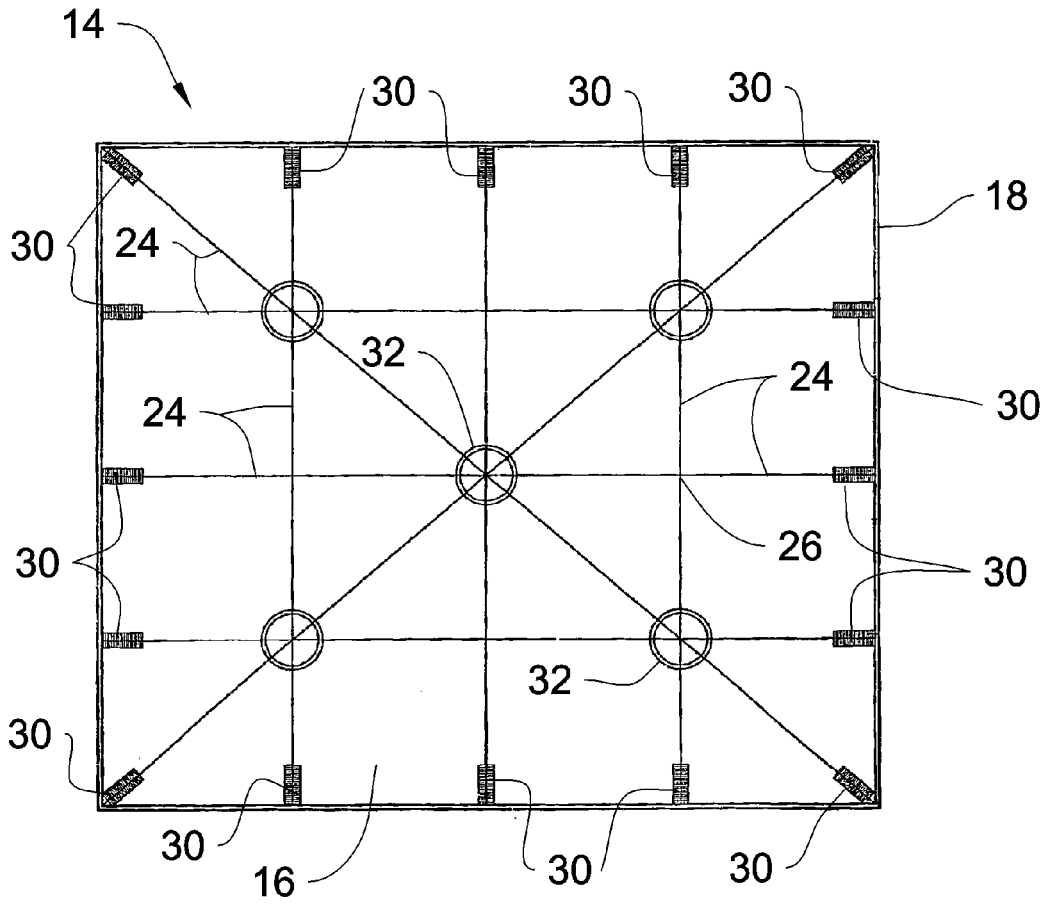
FIG. 2 is a plan top view of the present invention.

The mesh 26 consists of eight plates 24 that cross over each other in a pattern, as best illustrated in FIG. 2. Three of the plates 24 are placed between two opposite sides 18, with three other plates 24 being placed between the opposite two sides 18, thereby intersecting perpendicular to each other. The final two plates 24 are placed between each corresponding corner of the sides 18, thereby intersecting at the center of the pattern. The springs 32 are located on the base and positioned to contact the four outer corners intersection points and the central intersection point of the crossing plates 24.

Figure 3:
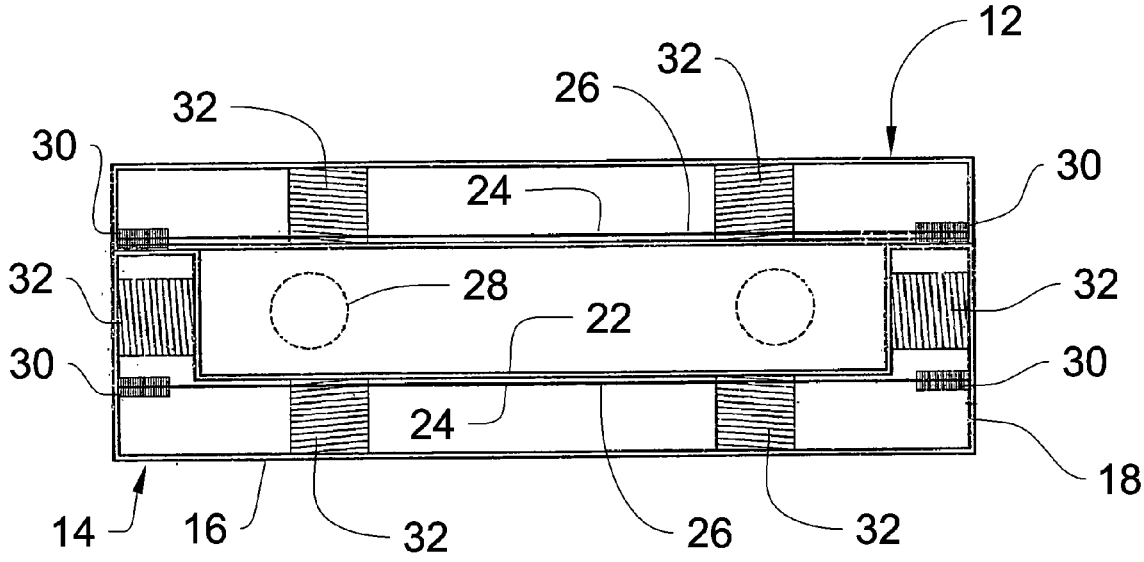
FIG. 3 is a cross-sectional view of the present invention in a closed configuration.

FIG. 3 illustrates a horizontal cut of the briefcase 10 in a closed configuration. The top cover part 12 consists of a similar interior lining 22, plates 24, mesh 26, and spring 30, 32 configuration as described above for the base 16. The interior lining 22 is positioned flat across the bottom of the top cover part 12 in the direction of the bottom part 14. As describe-above, the mesh 26 consisting of crossing plates 24 is covered by the interior lining 22 and biased against the lining 22 by springs 32. The ends of the plates 24 are connected to the sides of the top cover part 12 by springs 30.

Figure 4:
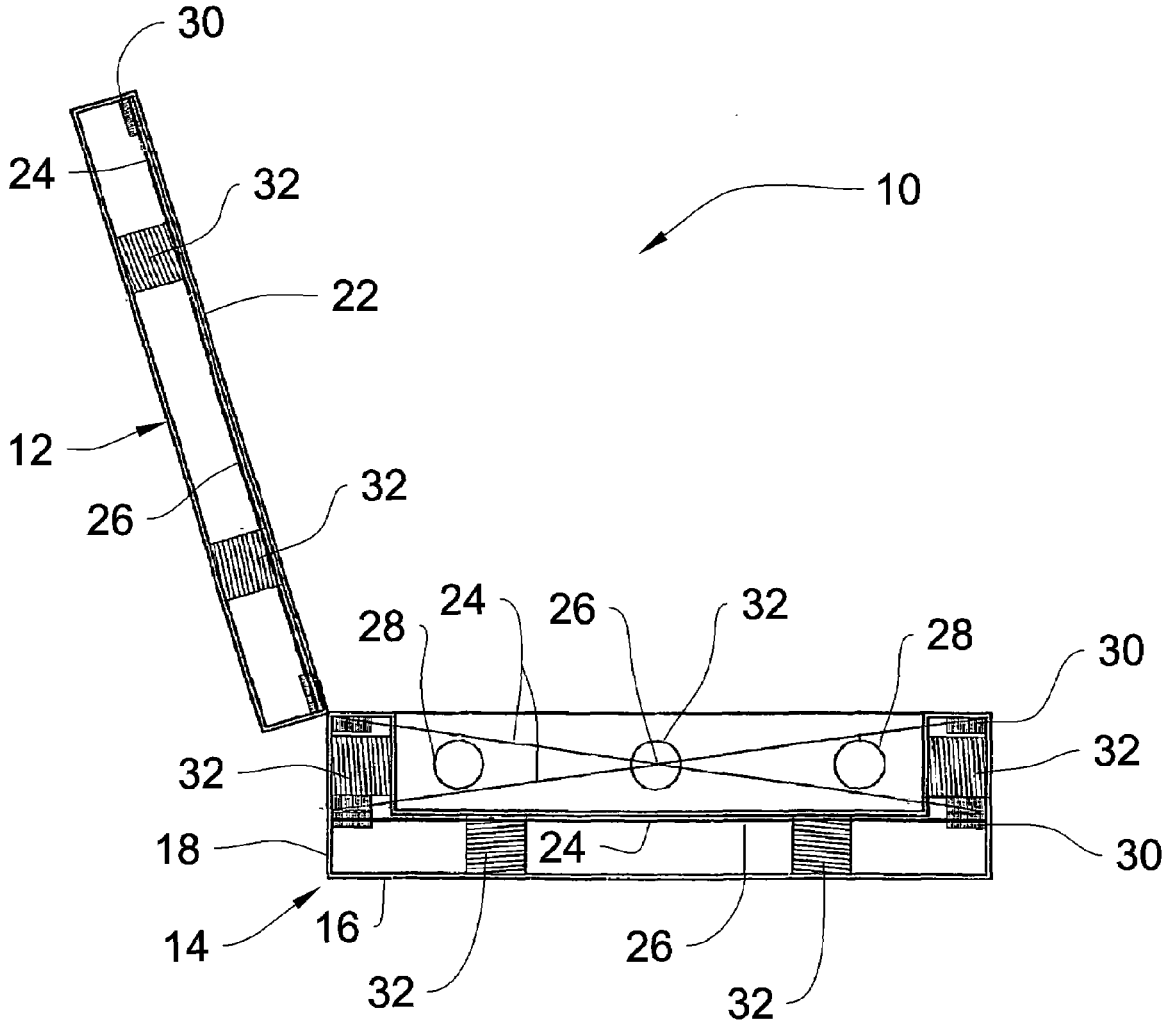
FIG. 4 is a cross-sectional view of the present invention in an opened configuration.

Each of the sides 18 further include two crossing plates 24, with the ends of each plate 24 being attached to opposite sides 18 via springs 30, thereby creating mesh 26 in all the exterior sides 18 of the bottom part 14. Spring 32 is situated between each exterior side 18 and the intersection point of the plates 24. The springs 32 are located at the intersection point of each crossing plate 24 in each side 18. Two springs 28 are positioned in each opening defined in the sides of the intersection point of plates 24 for each mesh 26 in each side 18, as best illustrated in FIG. 4.

The springs 28 connect the exterior sides 18 of the bottom part 14 with the interior flexible case 20. This is how the interior case 20 size is reduced and increased and that is the reason why the springs 28 stick out from the mesh 26 created by the crosswise connection of the plates 24.

The interior lining 22 is made of pliable texture so that the size of the interior case 20 is reduced and increased easier. The interior lining 22 covers the base and side meshes 26.

While a preferred embodiment of the protective laptop-briefcase has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A protective portable computer case for protecting and securely transporting a portable computer, said case comprising:

a bottom part having a base, sides, and an open top;

a top part having a plurality of springs, a plurality of plates, and an interior lining, said top part being pivotally attachable to said bottom part, said plates extend between opposing sides of said top part to create a mesh of said plates with intersection points where said two respective plates cross, each of said springs extend from said top part to one of said intersection points of said crossing plates of said top part, each end of said plates being attached to its said respective side, said interior lining covers said mesh and said springs; and an interior flexible case positionable in said bottom part, said interior flexible case defines a recess adapted to receive a portable computer therein, said interior flexible case includes a plurality of springs, a plurality of plates, and an interior lining, said plates extend between opposing said sides and parallel to said base to create a mesh of said plates with intersection points at where said two respective plates cross, wherein each end of said plates being attached to its said respective side, said interior lining covers said mesh and said springs, each of said springs extend from said base to one of said intersection points of said crossing plates of said interior flexible case.

2. The protective portable computer case as set forth in claim 1, wherein said interior lining of said top and bottom parts has a pliable texture.

3. The protective portable computer case as set forth in claim 1, wherein each end of said plates of said top and bottom parts are attached to their said respective sides by a spring.

4. The protective portable computer case as set forth in claim 3, wherein said plurality of plates of said interior flexible case is a first set of three plates extending between opposing said sides, and a second set of three plates extending between opposing said sides adapted perpendicularly crossing over said first set of said plates.

5. The protective portable computer case as set forth in claim 4, wherein said plurality of plates of said interior flexible case further comprising two plates each extending between opposing corners of said sides of said bottom part parallel with said base, said two plates adapted to intersect at a central location of said bottom part.

6. The protective portable computer case as set forth in claim 5, wherein said springs of said interior flexible case are positioned between said base and a central intersection point and said intersection points located at the outer four corners of said mesh.

7. The protective portable computer case as set forth in claim 6, wherein each of said sides of said bottom part further comprising a side mesh parallel with said side, and a spring between said side and said side mesh, said side mesh comprising of at least two plates extend between said adjacent and opposing sides and crossing over each other to create an intersection point, said spring is located at said two plates intersection point.

8. The protective portable computer case as set forth in claim 7, wherein the ends of each of said two plates are attached to their respective sides by a spring.

9. The protective portable computer case as set forth in claim 8, wherein each of said sides further comprising at least two additional springs located between said side and said interior lining, said springs being positioned in a defined open space on both sides of said intersection point of said two plates.

10. The protective portable computer case as set forth in claim 9, wherein said side meshes are positioned in a plane that is perpendicular to and above said mesh parallel with said base, thereby allowing said defined recess of said interior flexible case to come in contact with all of said meshes and said additional springs of said sides of said bottom part.

11. The protective portable computer case as set forth in claim 10, wherein said mesh and said interior lining of said top part are adapted to be planar and make contact with said sides of said bottom part thereby covering said defined recess of said interior flexible case.

12. A protective portable computer case comprising:

a bottom part having a base, sides, and an open top;

a top part having a plurality of springs, a plurality of plates, and an interior lining, said top part being pivotally attachable to said bottom part, said plates extend between opposing sides of said top part to create a mesh of said plates with intersection points where said two respective plates cross, each of said springs extend from said top part to one of said intersection points of said crossing plates of said top part, each end of said plates being attached to its said respective side by a spring, said interior lining covers said mesh and said springs; and an interior flexible case positionable in said bottom part, said interior flexible case defines a recess adapted to receive a portable computer therein, said interior flexible case includes a plurality of springs, a plurality of plates, and an interior lining, said plates extend between opposing said sides and parallel to said base to create a mesh of said plates with intersection points at where said two respective plates cross, wherein each end of said plates being attached to its said respective side by a spring, said interior lining covers said mesh and said springs, each of said springs extend from said base to one of said intersection points of said crossing plates of said interior flexible case;

wherein each of said sides of said bottom part further comprising a side mesh parallel with said side, and a spring between said side and said side mesh, said side mesh comprising of at least two plates extend between said adjacent and opposing sides and crossing over each other to create an intersection point, said spring is located at said two plates intersection point;

wherein each of said sides of said bottom part further comprising at least two additional springs located between said side and said interior lining, said springs being positioned in a defined open space on both sides of said intersection point of said two plates.

13. The protective portable computer case as set forth in claim 12, wherein said interior lining of said top and bottom parts has a pliable texture.

14. The protective portable computer case as set forth in claim 12, wherein said plurality of plates of said interior flexible case is a first set of three plates extending between opposing said sides, and a second set of three plates extending between opposing said sides adapted perpendicularly crossing over said first set of said plates.

15. The protective portable computer case as set forth in claim 14, wherein said plurality of plates of said interior flexible case further comprising two plates each extending between opposing corners of said sides of said bottom part parallel with said base, said two plates adapted to intersect at a central location of said bottom part.

16. The protective portable computer case as set forth in claim 15, wherein said springs of said interior flexible case are positioned between said base and a central intersection point and said intersection points located at the outer four corners of said mesh, and wherein the ends of each of said two plates are attached to their respective sides by a spring.

17. The protective portable computer case as set forth in claim 16, wherein said side meshes are positioned in a plane that is perpendicular to and above said base mesh parallel with said base, thereby allowing said defined recess of said interior flexible case to come in contact with all of said meshes and said additional springs of said sides of said bottom part.

18. The protective portable computer case as set forth in claim 17, wherein said mesh and said interior lining of said top part are adapted to be planar and make contact with said sides of said bottom part thereby covering said defined recess of said interior flexible case.

19. A protective portable computer case comprising:

a bottom part having a base, sides, and an open top;

a top part having a plurality of springs, a plurality of plates, and an interior lining, said top part being pivotally attachable to said bottom part, said plates extend between opposing sides of said top part to create a mesh of said plates with intersection points where said two respective plates cross, each of said springs extend from said top part to one of said intersection points of said crossing plates of said top part, each end of said plates being attached to its said respective side by a spring, said interior lining covers said mesh and said springs; and an interior flexible case positionable in said bottom part, said interior flexible case defines a recess adapted to receive a portable computer therein, said interior flexible case includes a plurality of springs, a plurality of plates, and an interior lining, said plates extend between opposing said sides and parallel to said base to create a mesh of said plates with intersection points at where said two respective plates cross, wherein each end of said plates being attached to its said respective side by a spring, said interior lining covers said mesh and said springs, each of said springs extend from said base to one of said intersection points of said crossing plates of said interior flexible case;

wherein each of said sides of said bottom part further comprising a mesh parallel with said side, and a spring between said side and said mesh, said mesh comprising of at least two plates extend between said adjacent and opposing sides and crossing over each other to create an intersection point, said spring is located at said two plates intersection point;

wherein each of said sides of said bottom part further comprising at least two additional springs located between said side and said interior lining, said springs being positioned in a defined open space on both sides of said intersection point of said two plates;

wherein said plurality of plates of said interior flexible case further comprising two plates each extending between said opposing corners of said bottom part parallel with said base, said two plates adapted to intersect at a central location of said bottom part.

* * * * *